United States Patent [19]

Olberding

[11] 4,389,817

[45] Jun. 28, 1983

[54] DOUBLE DOOR ASSEMBLY

[76] Inventor: Leonard E. Olberding, 12960 Quivira, Overland Park, Kans. 66213

[21] Appl. No.: 268,714

[22] Filed: Jun. 1, 1981

[51] Int. Cl.[3] ..... E05D 15/48; E05B 65/04

[52] U.S. Cl. ..... 49/163; 49/62; 49/67; 49/395

[58] Field of Search ..... 49/163, 169, 62, 65, 49/67, 395, 394; 292/144; 70/278, 277

[56] References Cited

U.S. PATENT DOCUMENTS

| | | | |
|---|---|---|---|
| 2,798,751 | 7/1957 | Walden | 49/394 X |
| 2,801,688 | 8/1957 | Singleton | 49/62 X |
| 3,192,448 | 6/1965 | Hevenor | 70/278 UX |
| 3,513,357 | 5/1970 | Dittmore | 70/278 X |
| 4,099,752 | 7/1978 | Geringer | 292/144 |
| 4,302,907 | 12/1981 | Canals et al. | 49/163 X |

*Primary Examiner*—Philip C. Kannan

*Attorney, Agent, or Firm*—Schmidt, Johnson, Hovey & Williams

[57] ABSTRACT

A novel way of keeping thieves out of dwellings and other spaces utilizes two interlocked, relatively nested doors which, when so interrelated, are in turn, separately locked as a unit within the door frame. Release from the exterior requires knowledge of a secret system of a push-button control which must be operated in proper sequence. Special, tamper-proof hinges, common to the doors, permit them to be hung in the door frame for separate swinging or movement as a unit. The interlock between the doors is releasable only from the inside and, upon such release, the outer door remains locked until separately released by the occupant.

5 Claims, 15 Drawing Figures

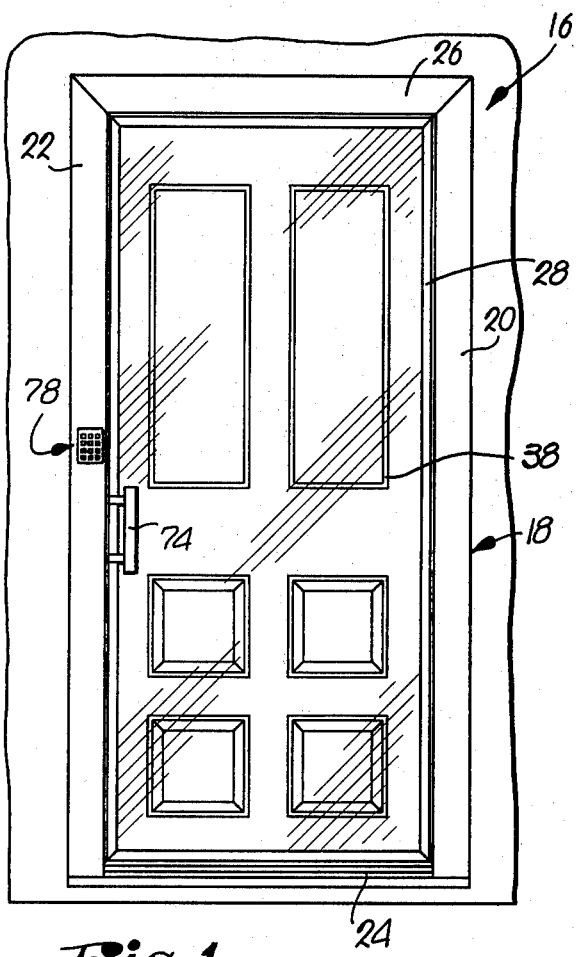
Fig.1.
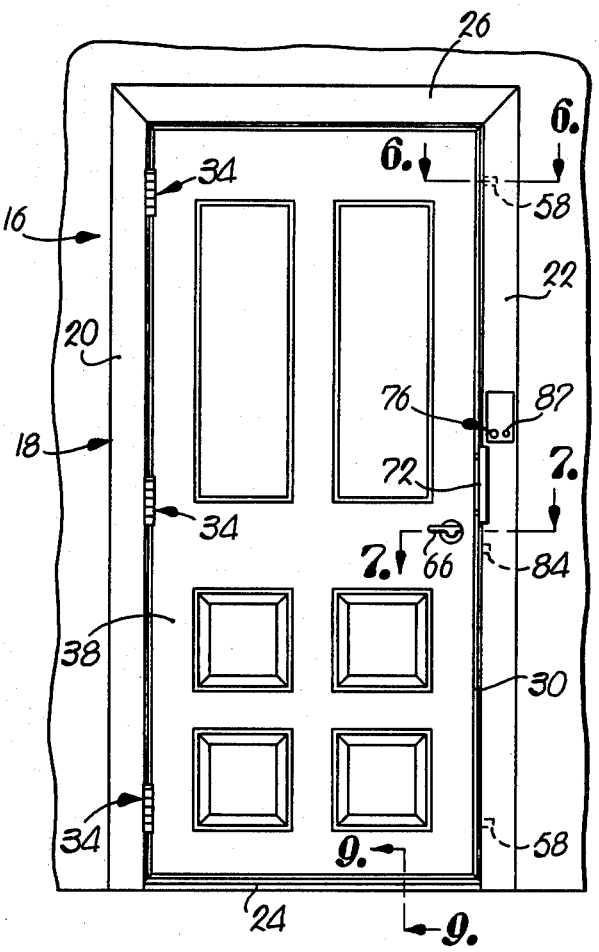
Fig.2.
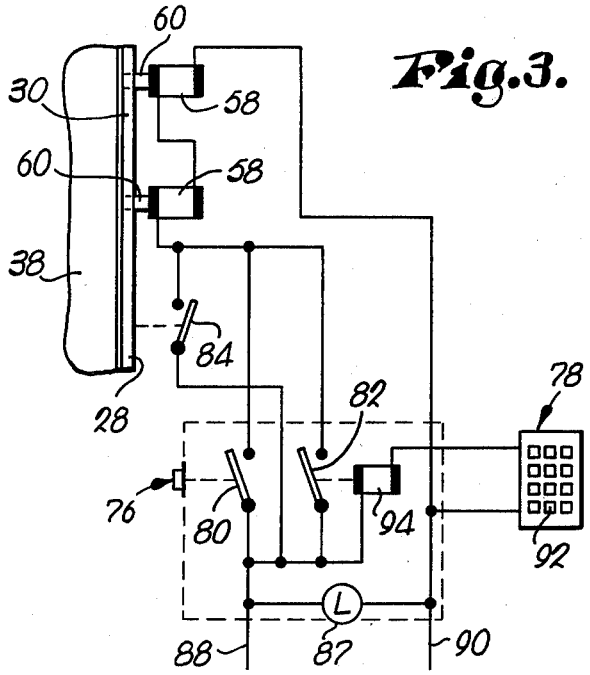
Fig.3.
Fig.4.
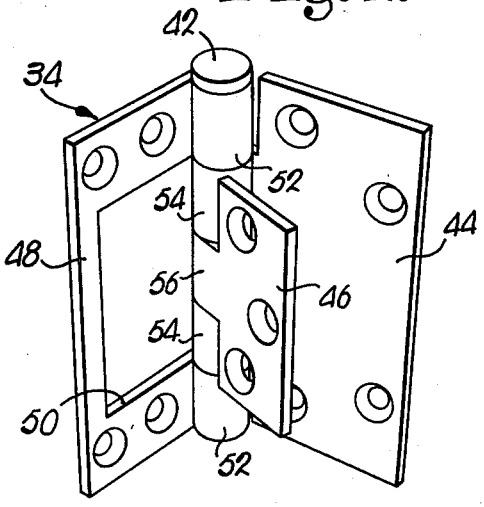

DOUBLE DOOR ASSEMBLY

Solutions to the ever-increasing, serious problem of unlawful entry, particularly in regard to residential dwellings, for whatever purpose on the part of the trespasser, oftentimes with dire accompanying circumstances and results, have been wide and varied but, insofar as I am aware, none have been placed in satisfactory use. Residential burglaries continue to rise at a startling rate nationwide and reports for the future are gloomy and startling. Grim tales of thievery, bodily harm and death leave little hope for peace of mind.

Doorways are especially vulnerable to building accessibility, whether or not occupied, even when all other openings are believed to be adequately locked. The need, therefore, is not limited to prevention of forced entry. Various forms of trickery are successfully employed to permit easy walk-in simply by knocking or ringing the door bell.

My present invention provides a door assembly which, when locked, not only requires extensive damage and destruction to effect forcible entry, but which protects occupants who fail to use proper care when responding to a rap on the door for admittance. Moreover, consideration has been given to maintaining desired esthetics or facade, as well as supplemental storm protection.

To those ends, I provide a safety assembly that includes a storm door having an inside door interlocked therewith and nested therewithin, the outer door being provided with its own independent locking system. The arrangement is such that within normal bounds of storm door breakage for intended forcible entry, the inner door continues to serve as an adequate barrier. Included is a secret exterior unlocking unit, together with releases for either or both doors located only within the interior of the building. Solenoid bolting of the outer door is hidden from view and rendered inaccessible by encasement within the door frame. Latching between the doors also invisible from the outside, can only be released from the interior.

As a result, thieves are quickly discouraged when force is attempted and response may be made to signals for admittance without fear because opening of the inner door, of itself, still leaves the wrongdoer devoid of a quick and simple solution to his intended entry purposes.

The following U.S. Letters Patents have been brought to my attention:

| NUMBER | NAME | DATE |
|---|---|---|
| 1,263,248 | Hope | April 16, 1918 |
| 1,799,719 | Zimmer | April 7, 1931 |
| 1,830,885 | Purdy | November 10, 1931 |
| 2,510,827 | McDonald | June 6, 1950 |
| 2,808,610 | Minor | October 8, 1957 |

In the drawings:

FIG. 1 is an outside elevational view of a double door assembly made according to my present invention;

FIG. 2 is an inside elevational view thereof;

FIG. 3 is a schematic view including a wiring diagram showing the electrical components of the assembly;

FIG. 4 is a perspective view of one of the hinges used in the assembly;

Figure 9:
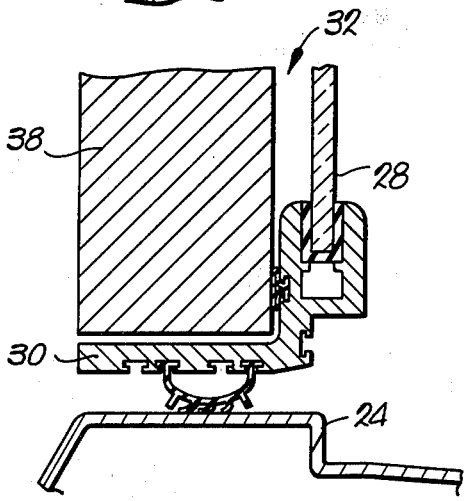
FIG. 9 is an enlarged, fragmentary, detailed cross-sectional view taken along line 9—9 of FIG. 2.

A door assembly 16 includes an open, upright framework 18 having a pair of horizontally spaced, vertical stiles 20 and 22, a threshold 24 (FIG. 9) between the stiles 20, 22 and an upper header 26 between the stiles 20, 22.

An upright, inwardly-opening outer door 28, complementally fitted within the framework 18, is provided with a continuous, inwardly-extending, flange-like, peripheral band 30 which presents an inwardly-facing cavity 32 extending the full width and height of the door 28.

Figure 5:
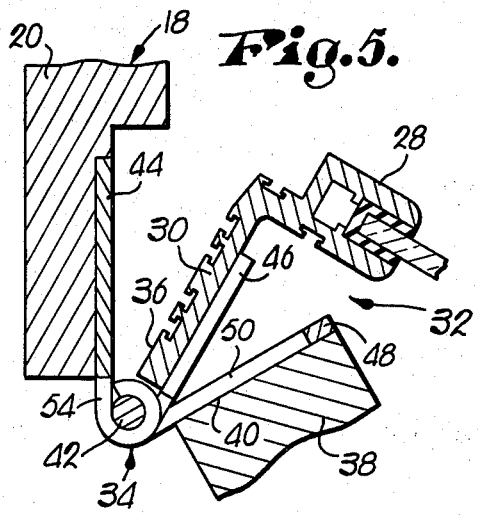
FIG. 5 is an enlarged, fragmentary, detailed cross-sectional view through one hinge of the assembly showing both doors partially open.

Two or more identical, vertically spaced hinges 34 (FIG. 4) are attached to the stile 20 and to the proximal vertical stretch 36 of the band 30 (FIG. 5). The hinges 34 operate to support the door 28 for horizontal swinging movement into and out of the framework 18. (Compare FIG. 12 with FIGS. 13–15).

Figure 14:
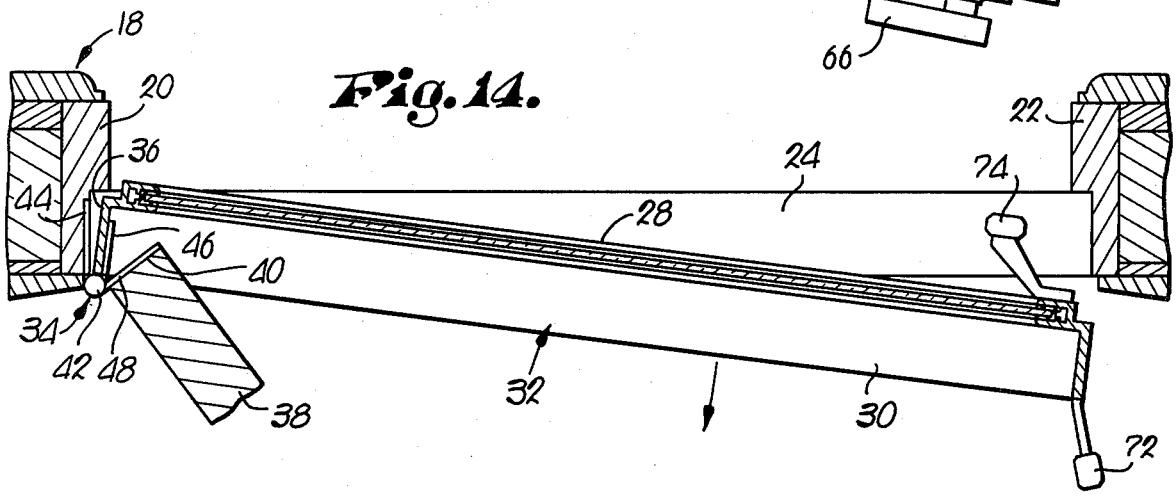

An upright, inwardly-opening inner door 38, complementally nested within the cavity 32 (FIG. 12), is operably connected with the hinges 34 along one vertical edge 40 of the door 38 as best shown, for example, in FIGS. 5 and 14.

The hinges 34 support the door 38 for horizontal swinging movement relative to the door 28 into and out of the cavity 32, and the hinges 34 have vertically aligned hinge pins 42 that are common to the doors 28 and 38. The pins 42 are disposed adjacent the inner face of the door 38 (FIGS. 12–15) and operate to permit horizontal swinging of the doors 28 and 38 as a unit about the axes of the pins 42 (FIG. 15).

Each hinge 34 has a first, rectangular leaf 44 attached to the stile 20, a second rectangular leaf 46 (somewhat smaller than the leaf 44) attached to the stretch 36 and a third U-shaped leaf 48 connected to the edge 40, presenting an opening 50 in the leaf 48 which receives the leaf 46.

The leaf 48 has a pair of vertically spaced, tubular knuckles 52; the leaf 44 has a pair of vertically spaced, tubular knuckles 54 between the knuckles 52; and the leaf 46 has a single tubular knuckle 56 between the knuckles 54. The pins 42 pass through all of the knuckles 52, 54 and 56.

Figure 12:
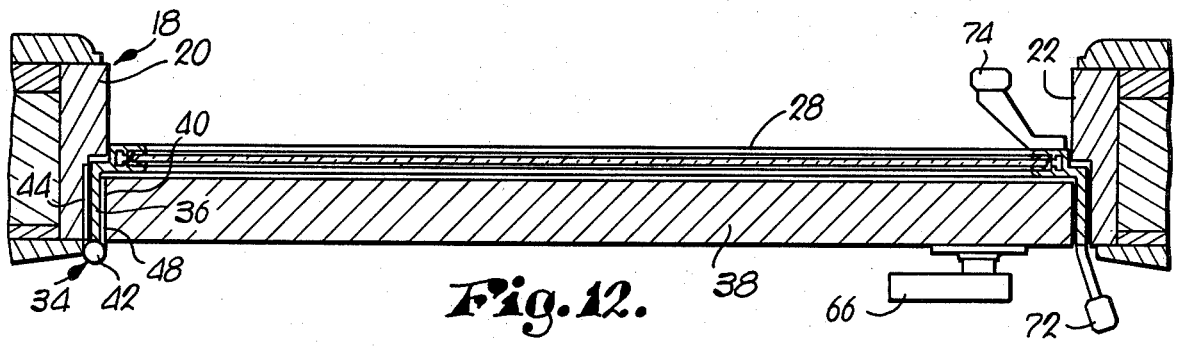
FIGS. 12–15 are horizontal cross-sectional views through the assembly of FIG. 2, showing various relative positions of the doors with respect to the framework.
Figure 15:
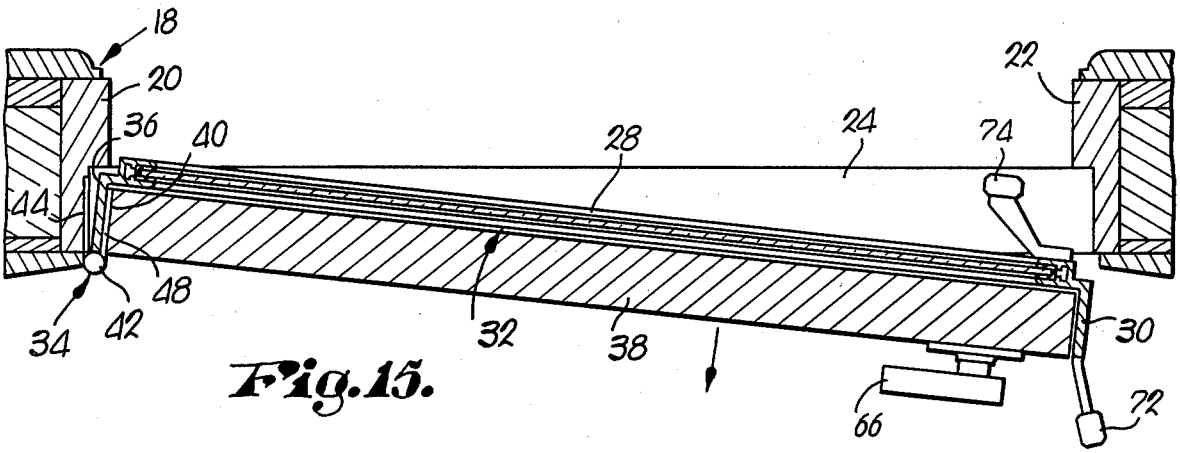

The leaf 44 is disposed between the stile 20 and the stretch 36 when the door 28 is closed (FIG. 12) and the leaves 46, 48 are disposed between the stretch 36 and the edge 40 when the door 38 is within the cavity 32 (FIGS. 12 and 15).

Figure 6:
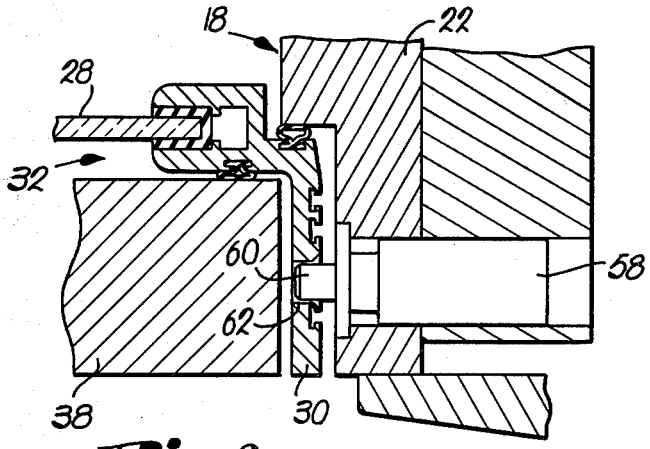
FIG. 6 is an enlarged, fragmentary, detailed cross-sectional view through the assembly taken along line 6—6 of FIG. 2 showing one of the solenoids thereof.
Figure 10:
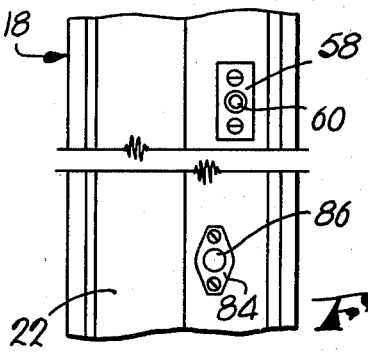
FIG. 10 is an enlarged, fragmentary, detailed elevational view within the cavity of the outer door showing the core of the solenoid of FIG. 6 and the switch of FIG. 8.

A pair of identical solenoids 58 (FIGS. 2 and 3) releasably lock the door 28 closed within the framework 18, one only of which is shown in FIG. 6 within the stile 22 and provided with a core 60 (FIGS. 6 and 10) reciprocable horizontally toward and away from the door 28 when it is in the framework 18. The band 30 has an aperture 62 for receiving the core 60 when the corresponding solenoid 50 is deenergized.

Figure 7:
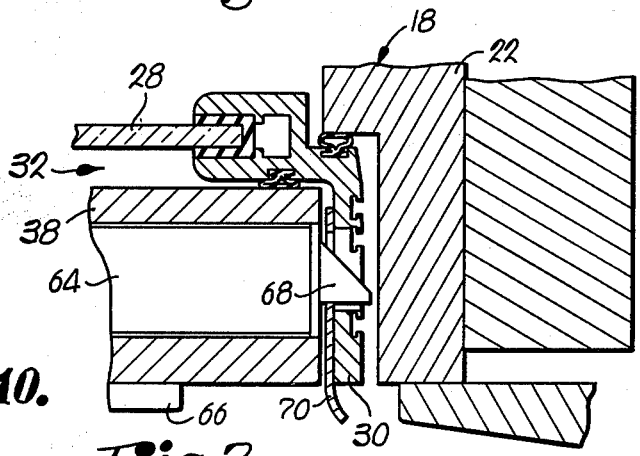
FIG. 7 is an enlarged, fragmentary, detailed cross-sectional view through the assembly taken along line 7—7 of FIG. 2 showing the inner door latch.
Figure 11:
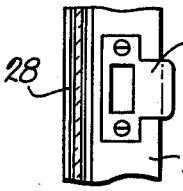
FIG. 11 is a view similar to FIG. 10 within the door-receiving framework showing the keeper for the latch shown in FIG. 7.
Figure 8:
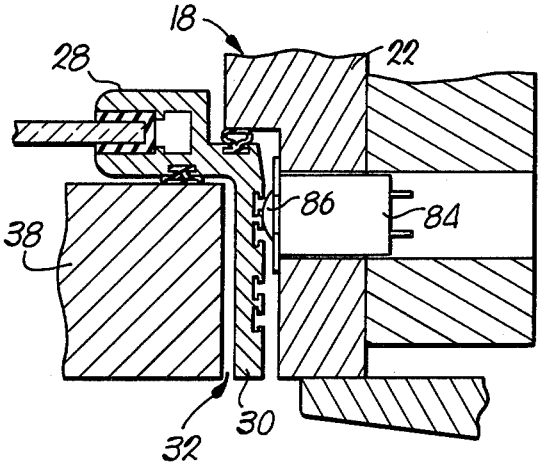
FIG. 8 is a view similar to FIGS. 6 and 7 showing the holding switch for the solenoids shown in FIG. 3.

Latch means 64 for releasably interlocking the doors 28 and 38 (FIGS. 7 and 11) when the door 38 is in the cavity 32 has a manual actuator 66 at the inner face only of the door 38 (FIGS. 2, 12, 13, 15). When the actuator 66 is operated, a spring-loaded catch 68 (FIGS. 7, 13) is retracted into the door 38 to withdraw it from its locking relationship with a keeper plate 70 (FIGS. 7, 11) secured to the band 30. Inner and outer pulls 72 and 74 respectively are provided on the door 28.

A pair of controls 76 and 78 are provided for the solenoids 58, the control 76 being disposed inwardly of the door 38 whereas the control 78 is located exteriorly of the door 28 and is provided with an actuating system capable of functioning secretly only by those having knowledge of its proper operation. The control 76 is in the nature of a push button for closing a switch 80 and the control 78 operates to control a switch 82 (FIG. 3). A third switch 84 may be manually closed by a push button 86 located inside the framework 18. (FIGS. 2, 3, 8 and 10). The switch 84 operates to energize the solenoids 58 to hold their cores 60 withdrawn after they are retracted from within the apertures 62 and the door 28 is swung from within the framework 18.

With reference now more particularly to FIG. 3, the solenoids 58, the control 78, the switches 80, 82 and 84 and a power indicator lamp 87 are operably coupled with power lines 88 and 90 operating from a transformer (not shown). The lamp 87 provides a signal to indicate whether or not the system is being supplied with the necessary electrical energy. In the event of power failure, the circuit switches over immediately to a back-up storage battery (not shown).

The control 78, in the nature of coded key sequence switching, utilizes a plurality of push buttons 92 which must be punched in proper sequence to energize a relay 94, and thereby close the switch 82, such sequential operation being maintained secret and being capable of rearrangement from time to time as may be desired.

Operation

Figure 13:
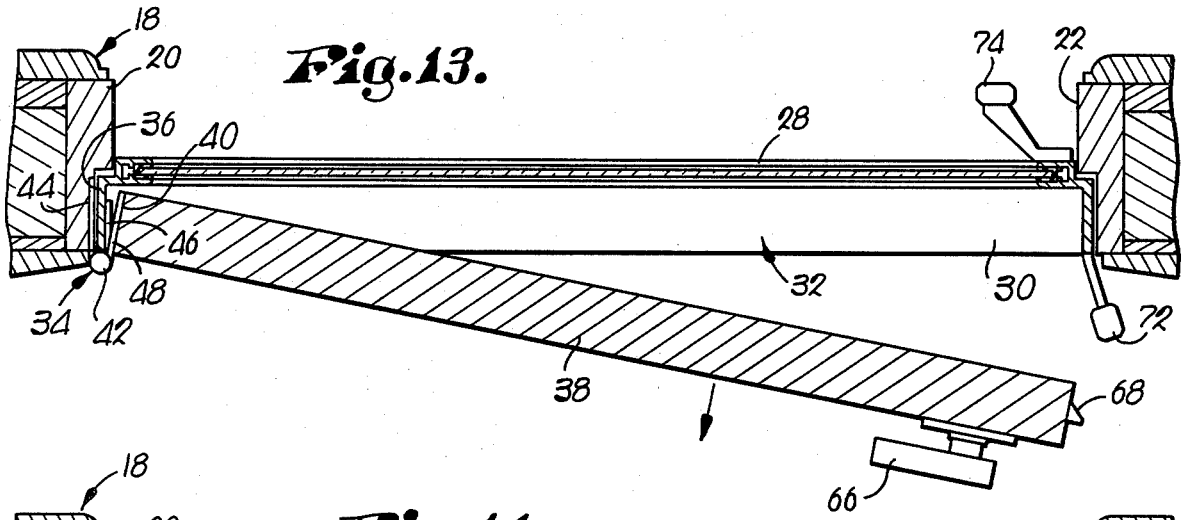

When both doors 28 and 38 are closed, as shown in FIGS. 1, 2, 6–9 and 12, the door 28 is locked by the cores 60 of the solenoids 58 within the apertures 62, and the door 38 is held closed by the catch 68 of the latch 64 in the keeper 70. The door 38 may be opened from the inside by operating the actuator 66 while the door 28 remains locked in its closed position by the solenoids 58. The operator simply pulls the door 38 inwardly by use of the actuator 66 as shown in FIG. 13.

This permits visability through the glass storm door 28 of anyone of the outside prior to opening of the door 28 whereupon, if safety is clearly no problem, the door 28 may be unlocked by depressing the inner control 76 to close the switch 80, thereby energizing the solenoids 58. The closed circuit through the solenoids 58 retracts the cores 60 from the apertures 62, permitting inward swinging of the door 28 by use of the pull 72 as seen in FIG. 14.

On the other hand, the switch 80 may be closed to permit opening of the door 28 by use of the pull 72 while the doors 28 and 38 remain interlocked by the latch 64 as illustrated in FIG. 15. Conversely, the door 28 may be closed by use of the pull 74 whether or not the doors 28 and 38 are locked together by the latch 64.

Access from the exterior requires knowledge of the pre-set sequence of depression of several of the switches 92 to, in turn, close the switch 82. A time delay in the control 78 before the switch 82 actually closes tends to foil would-be intruders who might attempt to find the right "combination" by trial and error depression of the switches 92. Closing of the switch 82 to unlock the door 28 permits the latter to be swung inwardly by use of the pull 74.

Whenever the door 28 is opened, from either the inside or the outside, it can be reclosed after closing the switch 84 to temporarily retract the cores 60 out of the way.

Especially noteworthy also is the fact that exterior tampering with the door 28 will be to no avail to a would-be thief. Even if the glass or screen of the door 28 is broken, the solenoids 58 remain inaccessible, precluding opening of the door 28, and neither the pins 42 nor the catch 68 can be reached to permit opening of the door 38. Unauthorized entry is, therefore, effectively prevented except by substantial force employed to virtually destroy or severely damage the doors 28 and 38 and/or the framework 18.

I claim:

1. A safety door assembly for reducing the risk of injury or loss resulting from robbery, burglary or unauthorized entry, said assembly including:

an open, upright framework having a pair of horizontally spaced stiles, a threshold between the stiles and an upper header between the stiles;

an upright, inwardly-opening outer door complementally fitted within, entirely surrounded by said framework and provided with a continuous, inwardly-extending, peripheral band complementally fitted within and entirely surrounded by said framework, presenting an inwardly-facing cavity extending throughout its width and height;

a number of vertically spaced hinges attached to one of said stiles and to the proximal vertical stretch of said band, said hinges supporting the outer door for horizontal swinging movement into and out of said framework;

an upright, inwardly-opening inner door complementally nested within said cavity, entirely surrounded by said band and operably connected with said hinges along one vertical edge of the inner door, said hinges supporting the inner door for horizontal swinging movement relative to the outer door into and out of said cavity, said hinges having vertically aligned hinge pins common to said door and disposed adjacent the inner face of the inner door for horizontal swinging of the doors as a unit about the axes of said pins; and a solenoid within the other of said stiles having a core reciprocable horizontally toward and away from the outer door when the latter is within said framework, said band being provided with a core-receiving aperture.

2. The invention of claim 1, and latch means having a manual actuator at the inner face only of the inner door for releasably interlocking the doors when the inner door is in said cavity.

3. The invention of claim 1; and a pair of solenoid controls, one disposed inwardly of the inner door, the other disposed outwardly of the outer door.

4. The invention of claim 3, said other control having an actuating system capable of functioning secretly only by those having knowledge of proper operation thereof.

5. The invention of claim 3; and means holding said core withdrawn after the core is retracted from the aperture and the outer door is swung from within the framework.

* * * * *